US005854610A

United States Patent [19]

Wojtowicz et al.

[11] Patent Number: 5,854,610

[45] Date of Patent: Dec. 29, 1998

[54] RADAR ELECTRONIC SCAN ARRAY EMPLOYING FERRITE PHASE SHIFTERS

[75] Inventors: John Wojtowicz, Hampstead; Richard S. Konapelsky, Columbia, both of Mass.

[73] Assignee: Northrop Grumman Corporation, Los Angeles, Calif.

[21] Appl. No.: 969,270

[22] Filed: Nov. 13, 1997

[51] Int. Cl.[6] ..... H01Q 3/22; H01Q 3/24; H01Q 3/26

[52] U.S. Cl. ..... 342/372; 342/157; 333/24.1

[58] Field of Search ..... 342/372, 157; 333/24.1

[56] References Cited

U.S. PATENT DOCUMENTS 3,986,149 10/1976 Harris et al. .

5,302,959 4/1994 Harrington et al. ..... 342/372

*Primary Examiner*—Theodore M. Blum

*Attorney, Agent, or Firm*—Walter G. Sutcliff

[57] ABSTRACT

A radar electronic scan apparatus 10 employs an array of transmit/receive phase-shift modules 14 with a plurality of ferrite phase-shift subarrays 16. Each ferrite phase-shift subarray has a pair of phase-shift ferrite substrates 32A and 32B mounted on a support with each substrate having four phase taps for connection to radiators of the electronic scan apparatus.

18 Claims, 5 Drawing Sheets

FIG.2
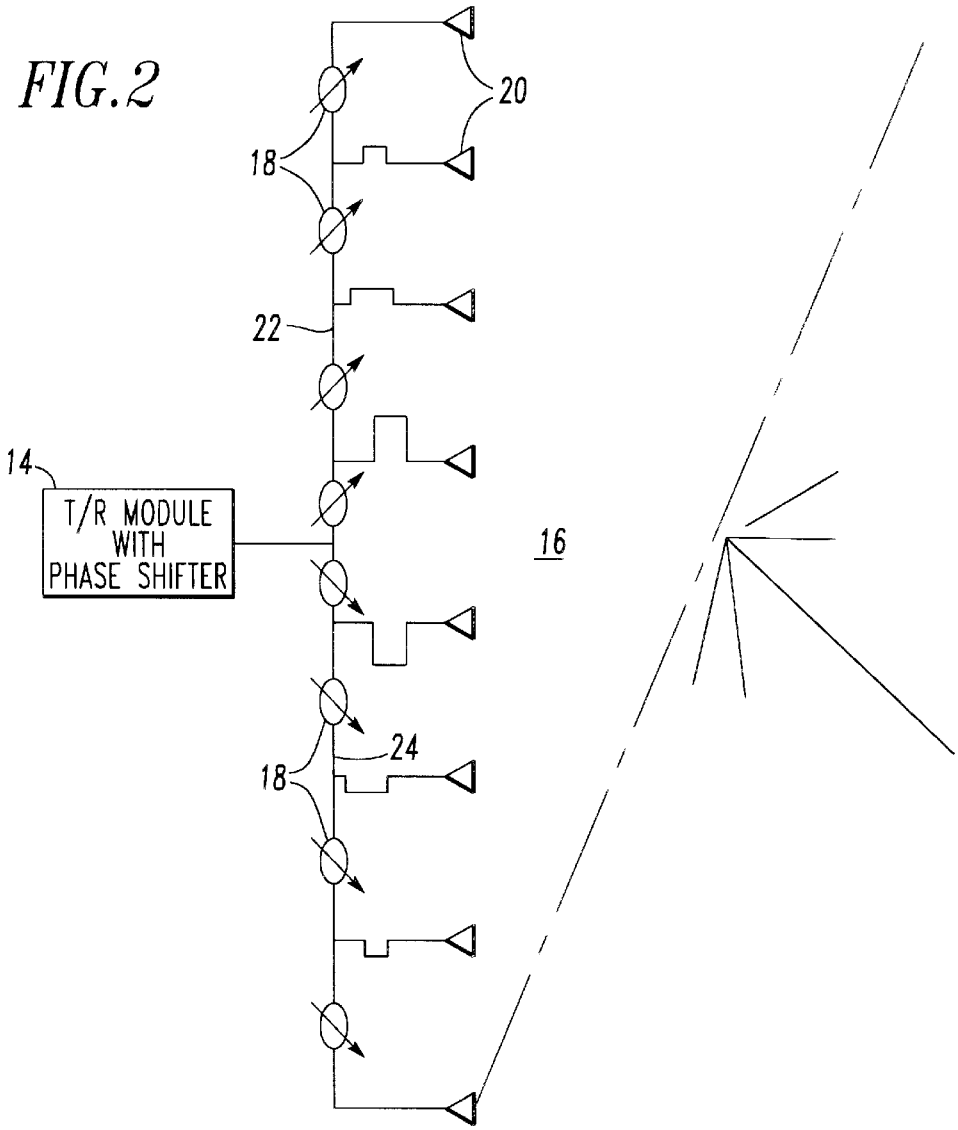
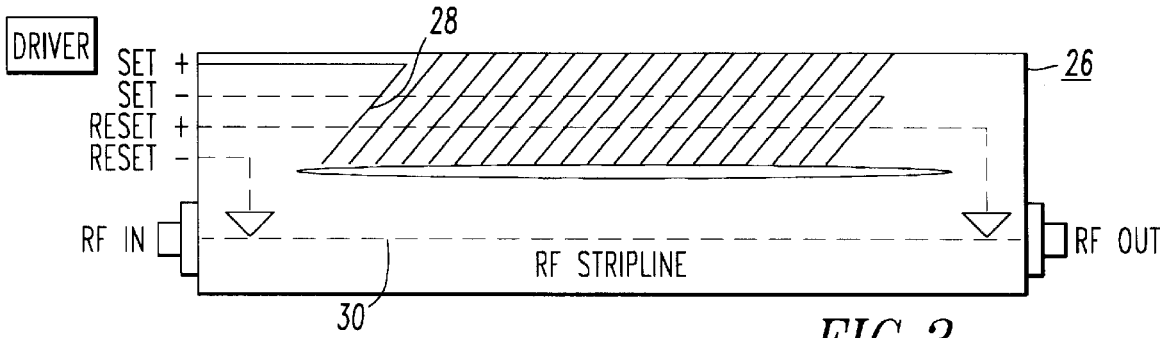
FIG.3

RADAR ELECTRONIC SCAN ARRAY EMPLOYING FERRITE PHASE SHIFTERS

The present invention relates to radar apparatus, and, more particularly, to electronic scan arrays employed in such apparatus to transmit and receive radar signals.

In an electronic scan array (ESA) for a radar system, numerous transmit/receive (TR) modules are arranged in a solid plane with respective radiators which radiate individual signals collectively forming a transmitted radar beam. The beam is directed outwardly within a design scan angle, such as 160 degrees. The TR modules are controlled so that individual, phase and amplitude controlled signals are radiated to form a beam of specified strength and direction.

The TR modules significantly contribute to the cost and weight of the ESA. A need has thus existed to develop ESAs which provide specified scanning performance with a reduced number of TR modules.

SUMMARY OF THE INVENTION

The invention is directed to a radar ESA in which a reduced number of TR modules are employed with ferrite phase shifting structure to provide specified ESA scanning performance with significant savings in product cost and weight.

The ESA comprises a plurality of transmit/receive (TR) modules coupled to an RF manifold system, with each TR module having RF amplifier circuitry and a phase shifter which generate a radio frequency (RF) signal for steering of the ESA beam as a whole. A ferrite phase shifter, forming a subarray, is coupled to each TR module to receive an associated RF signal therefrom, to phase shift such RF signal and generate multiple output signals phase shifted by different amounts on the basis of permeability control applied to ferrite material of the ferrite phase shifter, and thereby to provide steering for a whole-beam sector associated with the ferrite phase shifter in the plane of the subarray.

Respective phase shifted output signals are applied from the phase shifter to radiators which generate the ESA beam.

BRIEF DESCRIPTION OF THE DRAWINGS

The accompanying drawings, which are incorporated in and constitute a part of this specification, illustrate a preferred embodiment of the invention and together with the description provide an explanation of the objects, advantages and principles of the invention. In the drawings:

FIG. 2 shows an enlarged schematic diagram of an architecture of a TR phase shifter module and subarray ferrite phase shifters employed in the ESA of FIG. 1;

FIG. 3 schematically shows a ferrite phase shifter device which illustrates the principles of phase shifting in ferrite substrate structures;

DESCRIPTION OF THE INVENTION

The invention makes use of low temperature, cofired, ceramic ferrite technology in providing phase shifting in radar ESAs so that reliable ESA performance is achieved with significant savings in product manufacturing cost and in product weight in the mobile or other platform in which it is to be used. This technology employs planar concepts and involves stripline, slotline, and/or coplanar waveguide structures. No use is made of the more bulky and expensive waveguide phase shifters commonly employed in prior-art fielded phased array systems.

Figure 1:
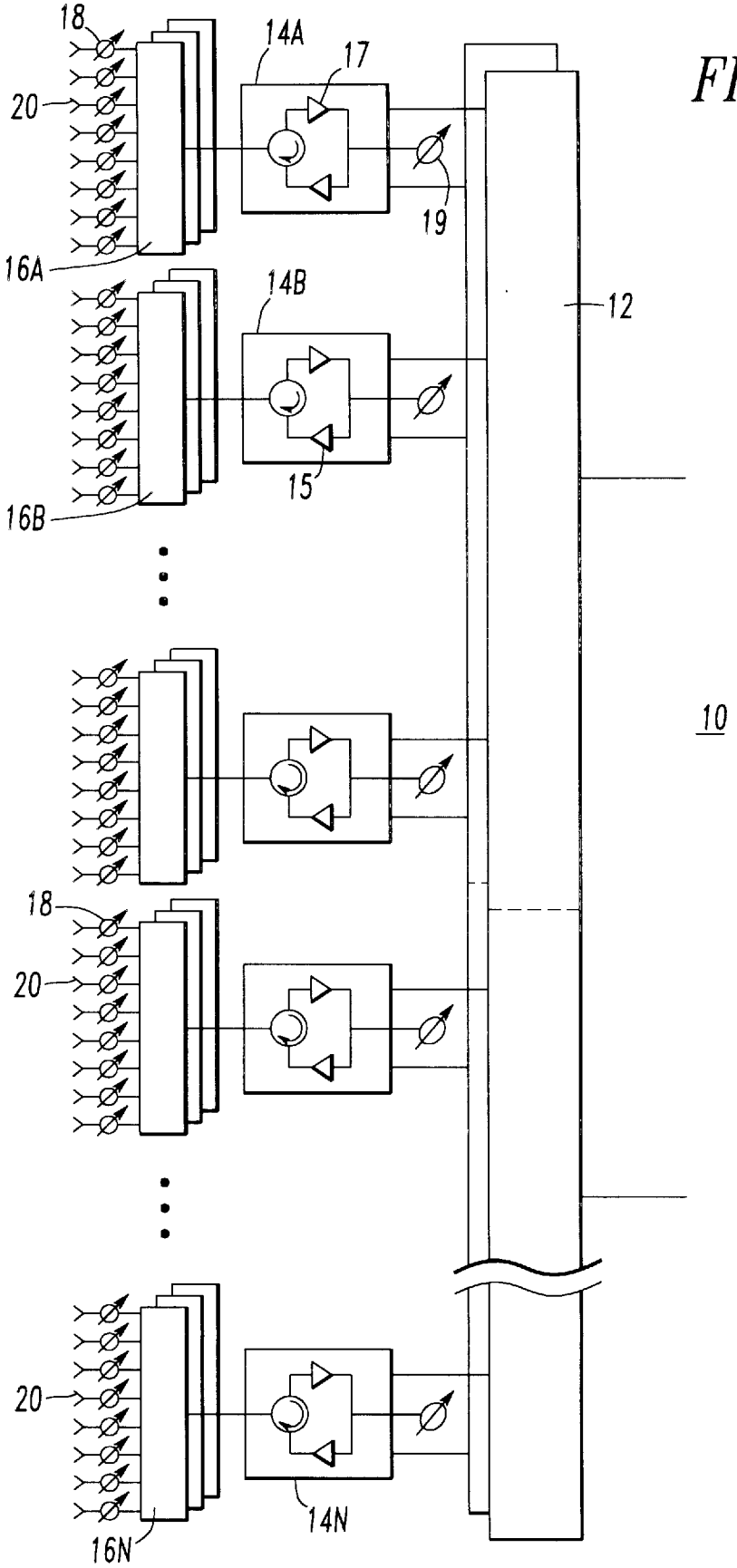
FIG. 1 is a schematic diagram of a representative portion of a radar ESA arranged in accordance with the invention.

More particularly, as shown in FIG. 1, a partially illustrated radar ESA 10 includes an RF manifold system 12 which feeds a plurality of TR modules 14, i.e., 14A through 14N. In turn, the respective TR modules 14A–14N are coupled to respective phase shifter subarrays 16, i.e. 16A–16N, which preferably embody ferrite technology as more fully described hereinafter.

Each TR module 14 includes a transmit amplifier 15, a receive amplifier 17 and a phase shifter 19. The T/R module phase shifters 19 provide for whole array scanning, while each subarray provides for steering the beam sector associated with the subarray relative to the whole array beam.

In this case, the entire ESA 10 may have a large number of radiator elements 20, such as 12,272. These radiator elements may, as indicated in FIG. 1, be arranged in 174 columns with 128 elements per column, or 16 subarrays of 8 elements per column.

Each ferrite phase shifter subarray 16 preferably includes eight ferrite phase shifters 18 and associated radiators 20, as shown. The number of ferrite phase shifters can be varied for different applications, but the cost and weight advantages of the invention diminish as the number of ferrite phase shifters is reduced. As the number of ferrite phase shifters is increased, circuit losses can become excessive especially where series-coupled, ferrite phase shifters are used.

The ferrite phase shifter subarray 16 is shown with enlarged detail in FIG. 2. The ferrite phase shifters 18 are embodied in ferrite substrate structure (not specifically indicated in FIG. 2), and, in this case, are connected in a series substrate path 22 or 24. The TR module 14 is coupled to both series paths 22 and 24 to supply an RF signal having an amplitude and phase shift based on intensity and direction control of the radar beam.

Preferably, the ferrite phase shifters 18 produce equal incremental phase shifts so that the successive radiators 20 along the path 22 or 24 receive successive signals having respective phase shifts of one, two, three, and four times the amount of the incremental phase shift.

In order to enable use of an ESA arranged in accordance with the invention, some limit is placed on scan requirements of the ESA. The following exemplary requirement suite shows how limited scan requirements can support novel array architectures.

Frequency Band: 10.0–10.7 GHz

AZ (azimuth) Scan: ±60°

EL (elevation) Scan: ±10°

Sidelobes: Low Rx AZ and EL

The AZ scan requirement is satisfied by column to column placement of T/R modules which contain MMIC phase shifter devices. Resultant spacing is on the order of 0.56λ at 10.7 GHz. (approx. 0.62"). The AZ Rx sidelobes are managed by proper weighting control in the RF manifold system of an antenna behind the T/R modules.

The EL scan requirement is satisfied by the combination of T/R module phase shifters and the ferrite phase shifter architecture shown in FIG. 2. In operation of this elevation circuit, each 8 element subarray has its own pattern which is scanned +/−10° in elevation. The T/R modules scan the array factor pattern +/−10° in elevation with the MMIC phase shifter. The 8 element RF circuit employs a phase shifter section interspaced along RF center fed, series feed couplers. As previously noted, this approach results in identical phase shifter sections which produce identical phase shifts. Make up line lengths establish a corporate feed architecture.

In the example, the elevation spacing is chosen to be 0.85λ at 10.7 GHz. This results in a spacing of 0.94". The interelement phase shift required to scan +/−10° at the maximum frequency is calculated from the following expression:

$$_ø=360°/\lambda\ d \sin(\pm 10°)$$

$$_ø=360°/\lambda(0.85) \sin(\pm 10°)=+/-53°$$

This translates into a design that produces 106° total phase shift between each element pair along the 8 element subarray. The top edge element of each subarray receives (3.5×53)=186° phase shift while the bottom edge element receives −186° in the series arrangement shown in FIG. 2. The required 372° total phase shift excursion is achieved across the subarray with phase shifters that are only capable of 106° total phase shift.

A basic ferrite stripline phase shifter 26 is shown in FIG. 3. The basic device passes an RF signal from one end of the device to the other end as a straight through circuit. The phase shift is acquired by passing a set current through a winding 28 which alters the magnetic permeability of the transmission line medium. This changes the propagation constant of the medium, thereby producing phase shift. "Reset" is achieved by passing a current through RF conductor 30 which DC couples to a single winding embedded in the ferrite.

More information on ferrite phase shifters is available in U.S. Patent application Ser. No. 08/511,927 (Attorney Docket No. BD-95-143), entitled "Planar Phase Shifters using Low Coercive Force And Fast Switching, Multilayerable Ferrite", and filed by John D. Adam et al on Aug. 8, 1995, and hereby incorporated by reference.

Figure 4A:
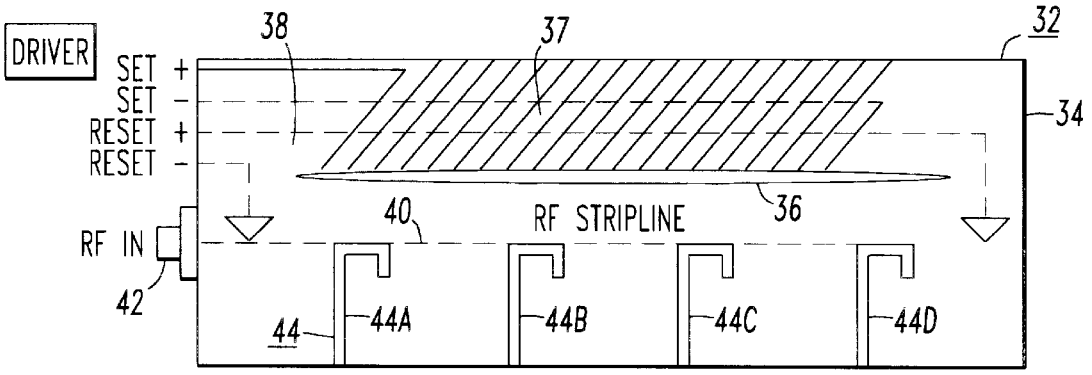
FIG. 4A illustrates a ferrite phase shifter device arranged in accordance with the invention for application in the ESA of FIG. 1.
Figure 4B:
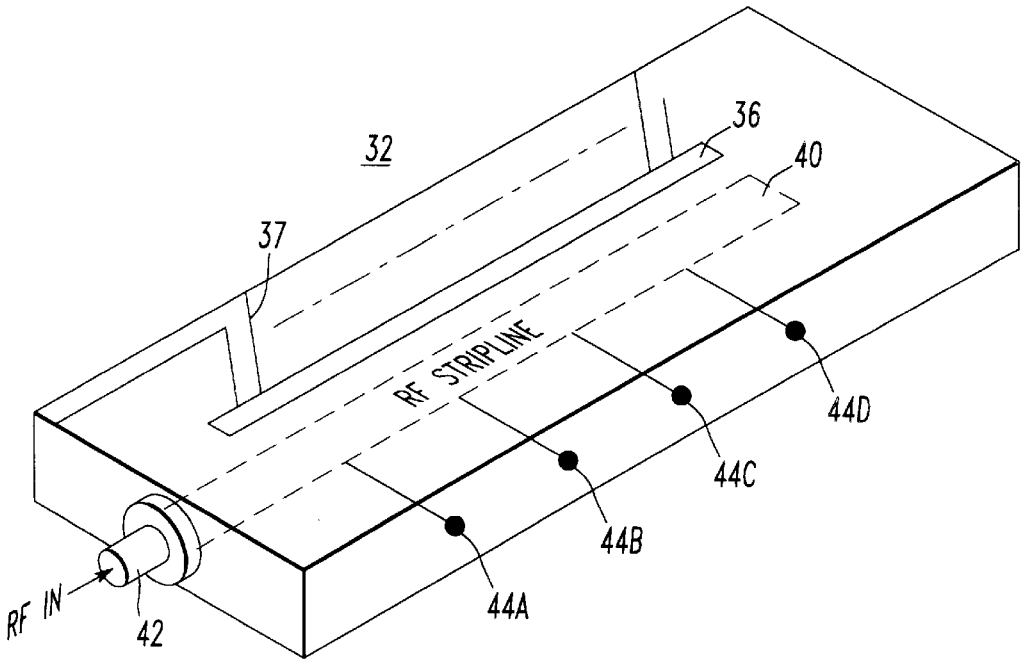
FIG. 4B is a perspective view of the ferrite phase shifter of FIG. 4A.

In FIGS. 4A and 4B, a ferrite, stripline phase shifter 32 is shown with structure arranged in accordance with the invention. Generally, stripline couplers are fabricated as a part of the ferrite phase shifter, and the couplers are properly positioned along the stripline preferably to achieve a maximum 106 degrees interelement phase shift.

The device 32 includes an elongated ferrite substrate 34 having a slot 36 through which a winding 37 is disposed about a leg portion 38 of the substrate 34. An RF stripline conductor 40 extends along the ferrite substrate 34 from an input terminal 42.

When a DC signal is passed through the winding, magnetic flux is created in a magnetic circuit which extends through the coil 37 and along the conductor 40 within the ferrite substrate 34. When the coil signal is ended, the remanent flux in the ferrite substrate 34 determines the substrate permeability, and, thereby, the amount of phase shift produced for an RF signal applied to the conductor 40.

Tap conductors 44 are preferably equally spaced along the length of the conductor 40 to provide respective output signals having incrementally increased phase shifts. With equal tap conductor spacings, the respective tap signals are phase shifted by equal increments.

In an exemplary sample unit, the device 32 was 372 degrees long electrically, with a substrate length of just under 5.8 centimeters. In applying the sample to an ESA, the four radiator elements 20 were spaced over a distance equal to about twice the length of the device 32.

Figure 5:
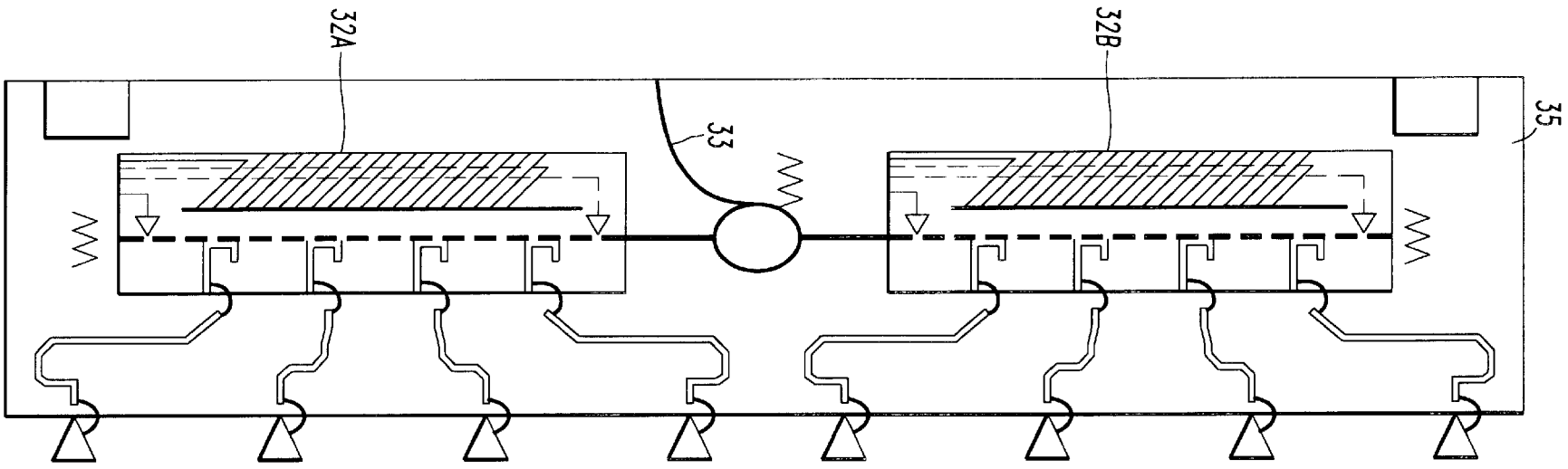
FIG. 5 is a schematic diagram of a ferrite phase shifter embodying the architecture of FIG. 2 with series phase shift circuitry and employed in the ESA of FIG. 1.

The basic structure of the phase shifter 32 of FIG. 4A is embodied in a ferrite phase shifter device 40 (FIG. 5) to provide a ferrite phase shifter structure with phase shifter elements 32A and 32B in correspondence to the phase shifter architecture shown in the subarray 16 of FIG. 2.

Low loss, lighter weight, X band air stripline is preferably used as the basis for the RF elevation feed. Two ferrite stripline phase shifter assemblies can be mounted onto the air stripline manifolds in predescribed "pockets". A single onboard monolithic driver provides the single current to the ferrite assembly which sets up 106° (or any value less than 106°) as a basis for scanning the beam 10° in elevation. Accordingly, a driver is provided per four phase shifters in accordance with the invention.

The coupling values of the ferrite couplers may typically be chosen to provide the low sidelobe subarray Rx taper in elevation, with the Tx pattern being approximately uniform with quantization effects. Each subarray preferably houses a unique portion of the taper to produce a full aperture Rx low sidelobe elevation pattern. This results in only sixteen unique subarrays since each array column is a repeat of these subarrays. The couplers may also be chosen to provide uniform illumination where the quantization lobes would now appear in the low sidelobe receive pattern and transmit would be a sin(x)/x pattern.

Figure 6:
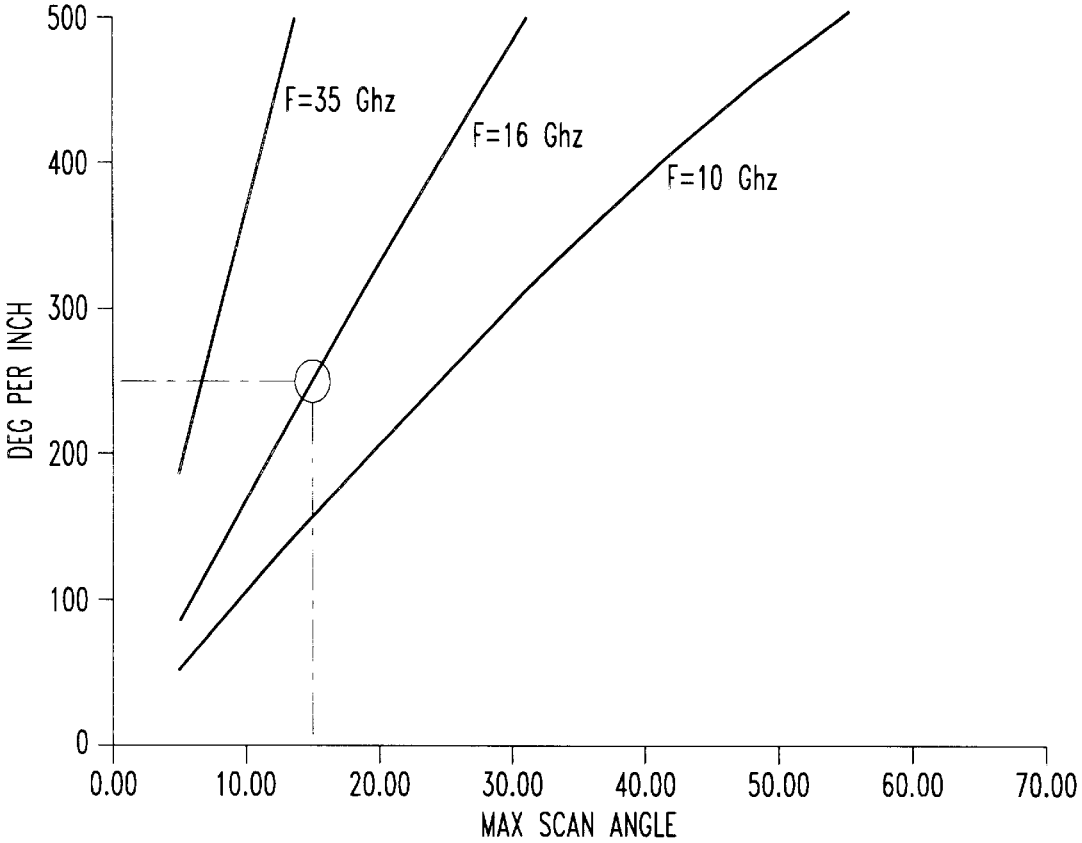
FIG. 6 is a graph showing phase shift per ferrite inch needed for a range of scan angles at different frequencies.

FIG. 6 shows a range of capability for limited scan array architecture of the invention. Current stripline ferrite designs can achieve as much as 250 degrees per inch at Ku Band. This translates into about +/−15 degree scan capability. At X band, this results in +/−25 degree scan.

Overall, the invention enables ESA structures to be made with low cost and light weight through use of a ferrite phase shifter subarray structure having multiple phase shift taps and controlled by a single monolithic driver circuit. As an example, an array which originally would have 22,272 phase shifter sites, is reduced to 5,568 phase shifter assemblies with use of the invention. Each phase shifter assembly may be slightly greater than a full 360° phase shifter device. This translates into a ferrite phase shifter weight reduction and cost reduction which are approximately one-fourth the prior cost weight and cost.

The foregoing description of the preferred embodiment has been presented to illustrate the invention without intent to be exhaustive or to limit the invention to the form disclosed. In applying the invention, modifications and variations can be made by those skilled in the pertaining art without departing from the scope and spirit of the invention. It is intended that the scope of the invention be defined by the claims appended hereto, and their equivalents.

What is claimed is:

1. An electronic scan array (ESA) for radar apparatus, the ESA comprising:

a plurality of transmit/receive (TR) modules coupled to an RF manifold system;

each TR module having RF amplifier circuitry and a phase shifter which generate a radio frequency (RF) module signal for steering of the ESA beam as a whole;

a ferrite phase shifter forming a subarray and coupled to each TR module to receive the RF module signal therefrom, to phase shift the RF module signal and generate multiple output RF signals phase shifted by different amounts on the basis of permeability control applied to ferrite material of the ferrite phase shifter, and thereby to provide steering for a whole-beam sector associated with the ferrite phase shifter;

the phase shifter having at least one elongated ferrite substrate structure;

at least one elongated RF conductor strip receiving the RF module signal, formed on the ferrite substrate structure, and extending longitudinally thereof;

a latching field coil structure coupled to the ferrite substrate structure, being operable to carry an electric current pulse and generate magnetic flux in the ferrite substrate structure along magnetic circuitry which extends along the conductor and within the field coil structure, thereby controlling the permeability of the ferrite substrate including magnetic material along the conductor; and a plurality of tap conductors secured to the ferrite substrate, connected to the conductor at respective selected points along the conductor, and disposed to provide output coupling of the phase shifted output signals to the associated radiators with phase shifting determined by the permeability of the ferrite substrate; and multiple radiators to which the respective phase shifted output RF signals of each phase shifter are applied for generation of the ESA beam.

2. The ESA of claim 1 wherein the tap conductors extend laterally from the conductor to a side of the ferrite substrate structure where output connections can be made, and the conductor is an RF strip conductor.

3. The ESA of claim 1 wherein the tap conductors are substantially equally spaced along the length of the conductor.

4. The ESA of claim 1 wherein four tap conductors are spaced along the length of the conductor.

5. The ESA of claim 1 wherein a ferrite assembly is provided and wherein the ferrite assembly includes:

at least a pair of the elongated ferrite substrate structures mounted on a support; and a coupling circuit for connecting the associated TR module to the respective conductors of the ferrite substrate structures.

6. The ESA of claim 5 wherein the coupling circuit performs a driving function.

7. The ESA of claim 5 wherein the tap conductors are substantially equally spaced along the length of the conductors of the ferrite substrate structures.

8. The ESA of claim 7 wherein four tap conductors are substantially equally spaced along the length of each conductor.

9. The ESA of claim 6 wherein the support is an X band air stripline element.

10. A ferrite phase shifter comprising:

at least one elongated ferrite substrate structure;

at least one elongated RF conductor formed on the ferrite substrate structure to receive an RF transmit signal and conduct the RF signal along its length;

a latching field coil structure coupled to the ferrite substrate structure, being operable to carry an electric current pulse and generate magnetic flux in the ferrite substrate structure along magnetic circuitry which extends along the conductor and within the field coil structure thereby controlling the permeability of the ferrite substrate including magnetic material along the conductor; and a plurality of tap conductors secured to the ferrite substrate, connected to the conductor at respective selected points along the conductor, and disposed to provide output coupling of respective phase shifted output signals to associated radiators with the phase of each output signal determined by the permeability of the ferrite substrate and the tap point of the associated tap conductor.

11. The ferrite phase shifter of claim 10 wherein the tap conductors extend laterally from the strip to a side of the ferrite substrate structure where output connections can be made.

12. The ferrite phase shifter of claim 10 wherein the tap conductors are substantially equally spaced along the length of the conductor.

13. The ferrite phase shifter of claim 11 wherein four tap conductors are spaced along the length of the conductor.

14. A ferrite phase shifter assembly comprising:

at least a pair of elongated ferrite substrate structures mounted on a support;

at least one elongated RF conductor formed on each ferrite substrate structure to receive an RF transmit signal and conduct the signal along its length;

a latching field coil structure coupled to each ferrite substrate structure, being operable to carry an electric current pulse and generate magnetic flux in the ferrite substrate structure along magnetic circuitry which extends along the associated conductor and within the field coil structure, thereby controlling the permeability of the ferrite substrate including magnetic material along the conductor; and a plurality of tap conductors secured to each ferrite substrate, connected to the associated conductor at respective selected points therealong, and disposed to provide output coupling of respective phase shifted output signals to associated radiators with the phase of each output signal determined by the ferrite substrate permeability and the tap point of the associated tap conductor.

15. The assembly of claim 14 wherein the tap conductors extend laterally from the associated conductor to a side of the ferrite substrate structure where output connections can be made.

16. The assembly of claim 14 wherein the tap conductors are substantially equally spaced along the length of the associated conductor.

17. The assembly of claim 14 wherein four tap conductors are spaced along the length of each conductor.

18. A method for operating an electronic scanning array (ESA) for radar apparatus, the steps of the method comprising:

operating each of a plurality of transmit/receive (TR) modules coupled to an RF manifold system to generate a radio frequency (RF) module signal for steering of the ESA beam as a whole;

operating each ferrite phase shifter, which forms a subarray coupled to each TR module, to receive the RF module signal for conduction along an elongated RF conductor of the phase shifter;

generating a magnetic flux in the phase shifter to control the permeability of magnetic material on which the RF conductor is disposed, thereby controlling delay time for the conduction of the RF module signal along the RF conductor;

generating multiple output signals from output taps spaced along the length of the RF conductor, the output signals phase shifted by different amounts according to the location of the output tap points, and thereby providing steering for a whole-beam sector associated with the ferrite phase shifter; and applying the respective phase shifted output signals of each phase shifter to radiators for generation of the ESA beam.

* * * * *

UNITED STATES PATENT AND TRADEMARK OFFICE

CERTIFICATE OF CORRECTION

PATENT NO. : 5,854,610

DATED : December 29, 1998

INVENTOR(S) : Wojtowicz et al

It is certified that error appears in the above-identified patent and that said Letters Patent is hereby corrected as shown below:

Column 1, line 11, "160 degrees" should be -- ± 60 degrees --

Signed and Sealed this

Eighth Day of June, 1999

*Attest:*

Q. TODD DICKINSON

*Attesting Officer*

*Acting Commissioner of Patents and Trademarks*